US005646461A

United States Patent [19]

Kubota

[11] Patent Number: 5,646,461

[45] Date of Patent: Jul. 8, 1997

[54] STOP SWITCH APPARATUS FOR AN ENGINE

[75] Inventor: Yosuke Kubota, Kokubunji, Japan

[73] Assignee: Fuji Jukogyo Kabushiki Kaisha, Japan

[21] Appl. No.: 629,457

[22] Filed: Apr. 10, 1996

Related U.S. Application Data

[63] Continuation of Ser. No. 114,063, Aug. 31, 1993, abandoned.

[30] Foreign Application Priority Data

Sep. 21, 1992 [JP] Japan ..... 4-251578

[51] Int. Cl.[6] ..... H01H 35/00

[52] U.S. Cl. ..... 307/116; 307/10.6; 307/141; 123/198 DC; 123/630; 200/5 A; 200/512

[58] Field of Search ..... 307/10.1, 10.6, 307/116, 125, 130, 141, 141.4, 141.8; 200/5 A, 512, 513, 516; 123/630, 651, 149 R, 198 DC, 632, 631; 361/256, 253, 257, 263

[56] References Cited

U.S. PATENT DOCUMENTS

| | | | |
|---|---|---|---|
| 3,735,068 | 5/1973 | Yanaga et al. | 200/512 |
| 4,328,782 | 5/1982 | Jundt et al. | 123/609 |
| 4,408,103 | 10/1983 | Smith, III | 200/517 |
| 4,684,767 | 8/1987 | Phalen | 200/5 A |
| 4,794,215 | 12/1988 | Sawada et al. | 200/512 |
| 4,916,262 | 4/1990 | Jungels-Butler et al. | 200/517 |
| 4,993,396 | 2/1991 | Miura | 123/651 |
| 5,076,250 | 12/1991 | Sasaki et al. | 123/630 |
| 5,117,218 | 5/1992 | Sasaki et al. | 307/10.1 |

*Primary Examiner*—David S. Martin
*Assistant Examiner*—Jonathan S. Kaplan
*Attorney, Agent, or Firm*—Beveridge, DeGrandi, Weilacher & Young, L.L.P.

[57] ABSTRACT

An inside case made of rubber is mounted in an outside case, a substrate integrally provided with an engine stop switch circuit and a switch electrode of an engine stop switch unit is assembled in the inside case, and its lower side is filled with curable insulating base material to be sealed. Further, a switch contact opposed to the switch electrode is formed of pressure sensitive conductive rubber, and a reversal spring is further interposed on the pressure sensitive conductive rubber. As a result, wirings are eliminated, a decrease in the size of the entire apparatus and simplification can be realized, and a metal contact is eliminated to improve durability.

4 Claims, 6 Drawing Sheets

STOP SWITCH APPARATUS FOR AN ENGINE

This application is a continuation, of application Ser. No. 08/114,063, filed Aug. 31, 1993, now abandoned, which application is entirely incorporated herein by reference.

BACKGROUND OF THE INVENTION

This invention relates to a stop switch apparatus for an engine in which an engine stop switch unit is integrated with an engine stop switch circuit. More particularly, the invention concerns a stop switch apparatus for an engine in which a source circuit from a magneto is earthed to forcibly stop the engine.

Heretofore, regarding a stop switch apparatus for an engine of this type, as disclosed, for example, in Japanese Patent Laid-Open Publication No. 18668/1991 or Japanese Utility Model Laid-Open Publication No. 30381/1982, in most stop switch apparatuses, when a stop switch for the engine is closed, a thyristor for stopping the engine of an engine stop switch circuit is turned on to charge a holding capacitor. Then, a turn-on voltage is applied to a gate of the thyristor for stopping the engine by a discharge voltage from the holding capacitor at a certain time constant. Even if the engine stop switch is returned to an off state, a cut-off of a primary side of an ignition coil is disabled by turning on the thyristor for stopping the engine, thereby to misfire the engine to stop the engine.

A normally open switch having a metal contact is frequently used as the engine stop switch.

In the above-described prior art, structures of the engine stop circuit and the engine stop switch are not clearly disclosed, but it is general to separately provide the engine stop circuit and the engine stop switch.

Accordingly, the engine stop switch apparatus is relatively increased in shape, and assembling is complicated due to necessity of wiring the engine stop circuit to the engine stop switch. In addition, the number of components is increased, and hence there is a problem in reliability of a product.

Since the metal contact is used in the switch, a contact defect easily occurs due to generation of rust, and there is a problem in durability in the case of use outside of a housing for a long period of time.

Heretofore, regarding a general-purpose engine having a magneto as a power supply, when an engine is stopped, a source circuit voltage applied to a primary side of an ignition coil is short-circuited by a thyristor circuit to eliminate induction of an insulating breakdown voltage at a secondary side of the ignition coil, thereby forcibly stopping the engine.

In general, a thyristor in the thyristor circuit is turned on by a signal from an engine stop switch or a control circuit for outputting an engine stop detection signal if an oil level becomes lower than a reference level, and a short-circuiting current of a magneto power supply is supplied to the thyristor through a short-circuiting resistor connected in series with the thyristor. For example, prior art is disclosed in Japanese Patent Laid-Open Publication No. 18668/1991 filed by the same assignee as this patent application. However, when the thyristor is turned on to short-circuit the magneto power supply, a relatively large peak voltage generated at both ends of the short-circuiting resistor is amplified by the ignition coil due to an irregularity in a voltage across the short-circuiting resistor caused by an irregularity in the magnetos and further superposition of high frequency components in the case of the short-circuit on the voltage at both ends of the short-circuiting resistor, and applied to the ignition plug. Then, there is a fear of occurrence of an inductive discharge due to application of the irregularity in an ignition system as well.

Therefore, even if the thyristor is turned on to short-circuit the magneto power supply, the engine is not easily stopped, and afterburn occurs in the engine, thereby decreasing durability of the engine.

SUMMARY OF THE INVENTION

Accordingly, an object of this invention is to provide a stop switch apparatus for an engine which eliminates necessity of wiring an engine stop switch circuit to an engine stop switch to reduce in size the entire apparatus, realizes a simplification, reduces the number of components and provides high reliability.

In order to achieve the above object, this invention provides a stop switch apparatus for an engine having an insulating base plate, a substrate laid on said insulating base plate, an electrode printed on said substrate, an insulating sheet for covering said electrode, an inside case laid on said insulating sheet for moving perpendicularly against said electrode, and an outside case fixed on said insulating base plate for covering said inside case and said substrate, an improvement of the apparatus which comprises a pressure sensitive member laid on said insulating sheet for contacting said electrode when said inside case is pushed; a reversal member interposed between said pressure sensitive member and said inside case for deforming thereof to contact said pressure sensitive member with said electrode when a predetermined force is applied at the center thereof; and said pressure sensitive member is made of a electric conductive material so as to form an engine stop switch circuit without wiring and to enable a precise switching function in a compact structure.

According to the arrangement as described above, the switch electrode of the engine stop switch unit and the engine stop switch circuit are integrally provided on the substrate. Therefore, wirings are eliminated, and a decrease in the entire apparatus and a simplification can be realized. Hence, the number of components and the number of assembling steps can be decreased. Further, since the switch contact opposed to the switch electrode of the engine stop switch unit is formed of the pressure sensitive member, a metal contact is eliminated thereby to improve durability.

Further, since the reversal member for setting a contact force to the switch electrode of the pressure sensitive member is interposed between the switch contact and the switch presser, an erroneous operation is eliminated, and reliability of the product is further improved.

Another object of this invention is to provide a stop switch apparatus for an engine which eliminates an influence of an irregularity in output voltages of individual magnetos when a source circuit voltage to be supplied from a magneto to an ignition system is short-circuited by a thyristor and a high frequency vibration when a source circuit is short-circuited and obtains an excellent engine stopping performance.

The above and other objects have been achieved by this invention, which concerns a stop switch apparatus having an arrangement as described above and further comprising a thyristor included in said engine stop switch circuit for stopping said engine by earthing a source circuit from a magneto to an ignition circuit; a resister directly connected to said source circuit for providing a short circuit; and a zener diode connected to said resister in parallel for supplying a reverse current in order to eliminate an occurrence of peak voltage at both ends of said resister so as to avoid malfunction of stopping said engine and generation of afterburn.

In this apparatus, according to the invention, the thyristor is turned on, so as to stop the engine, to short-circuit the source circuit voltage to be supplied from the magneto to the ignition system, and a short-circuiting current is supplied through the short-circuiting resistor. Then, if the voltage at both ends of the short-circuiting resistor becomes a predetermined voltage or higher due to the irregularity in the output voltages of the magnetos and a high frequency vibration in the case of the short-circuiting, the portion of the short-circuiting current is fed as a reversal current through the zener diode.

The nature, utility, and further features of this invention will be more clearly apparent from the following detailed description with respect to preferred embodiments of the invention when read in conjunction with the accompanying drawings, briefly described below.

BRIEF DESCRIPTION OF THE DRAWINGS

In the accompanying drawings:

FIG. 8 is a waveform diagram illustrating a source circuit voltage when the thyristor for stopping the engine is turned on.

DETAILED DESCRIPTION OF THE INVENTION

Figure 1:
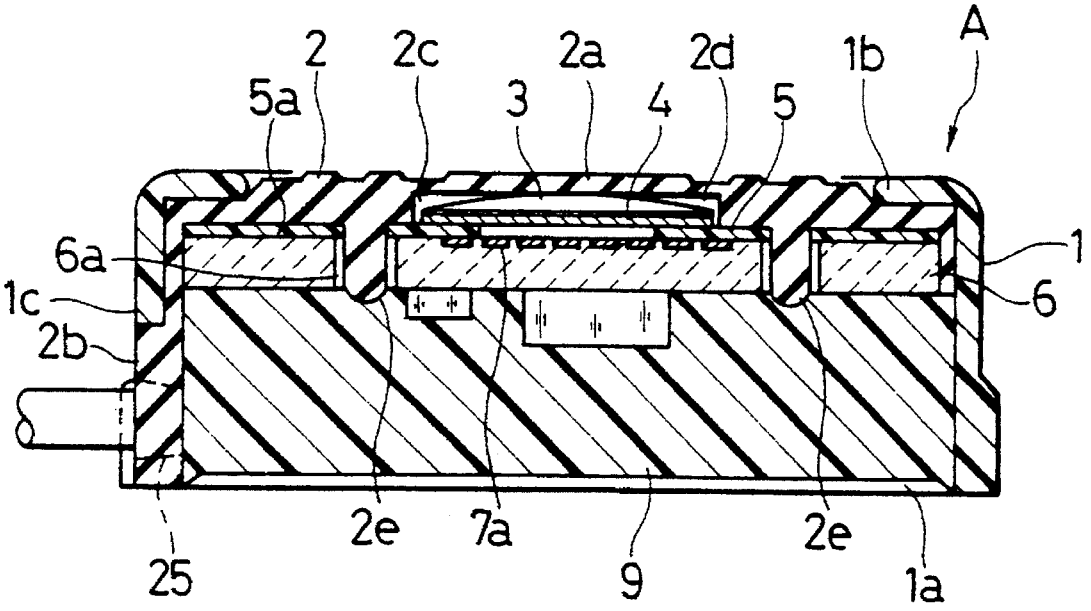
FIG. 1 is a sectional view taken along the line I—I of FIG. 3 illustrating an embodiment of a stop switch apparatus for an engine according to the present invention.
Figure 2:
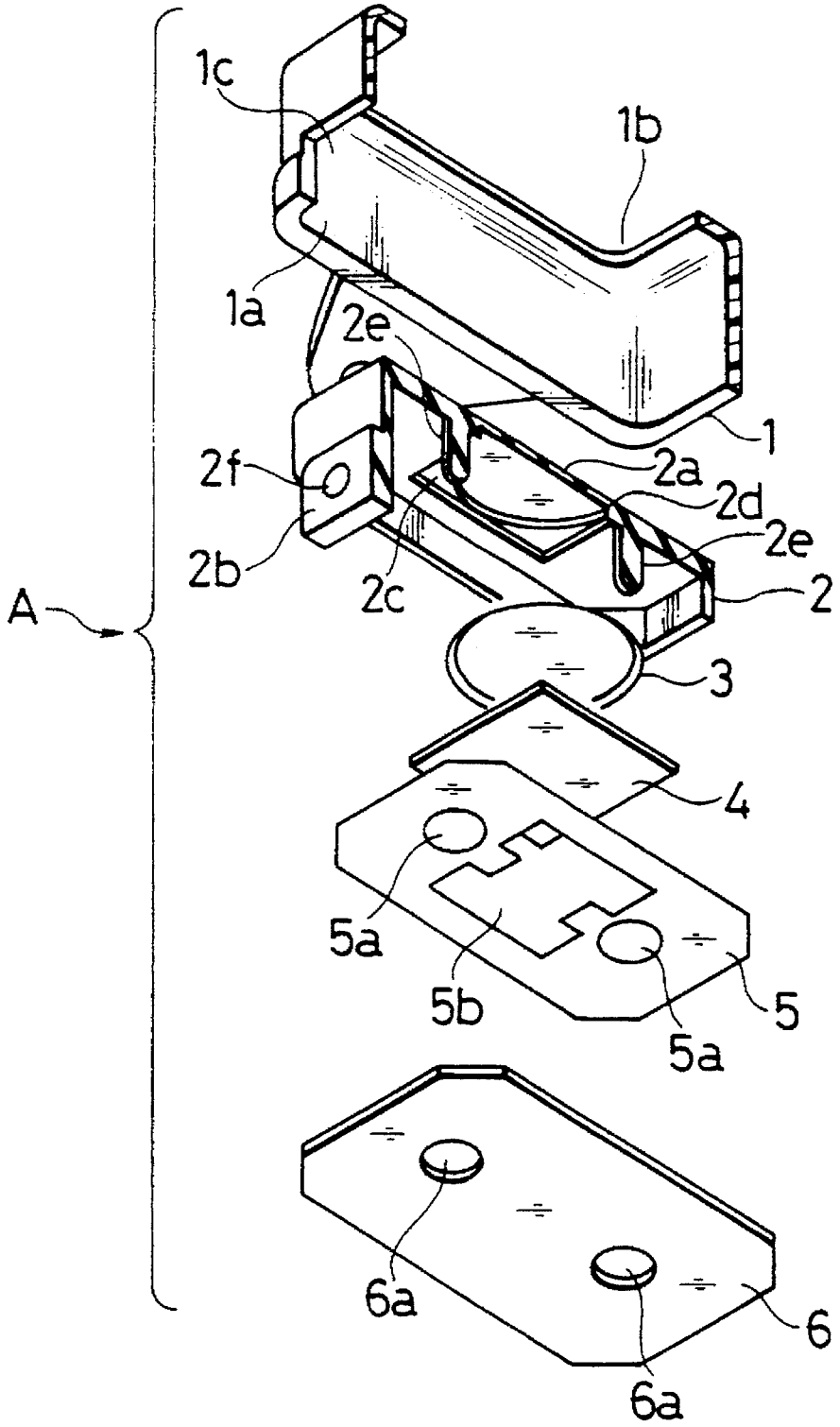
FIG. 2 is an exploded perspective view in partial section of the embodiment.
Figure 3:
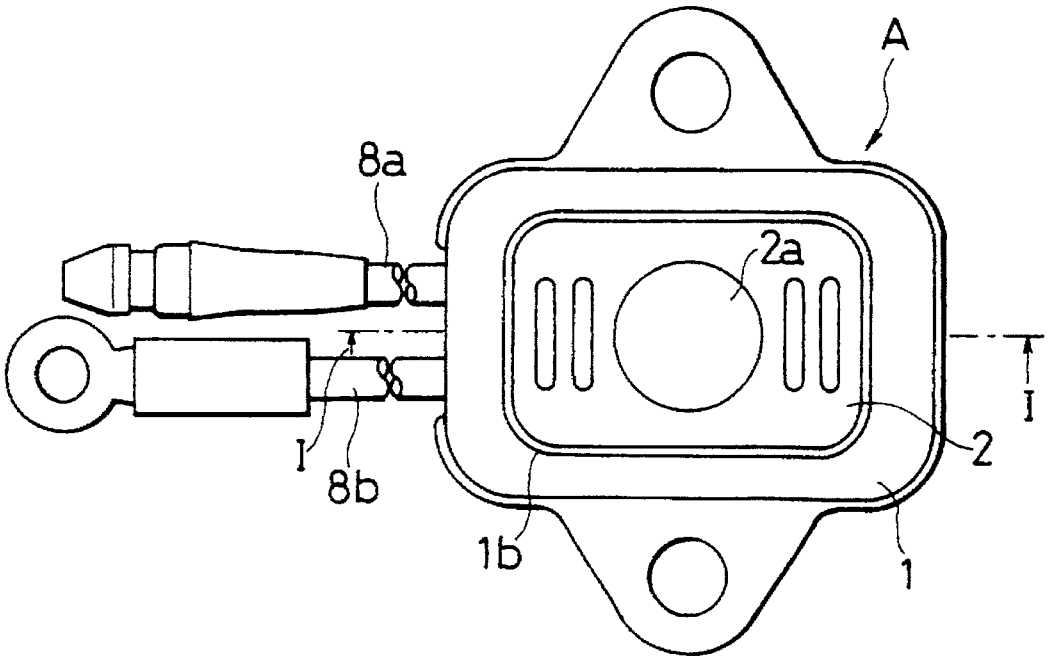
FIG. 3 is a plan view of the embodiment.
Figure 4:
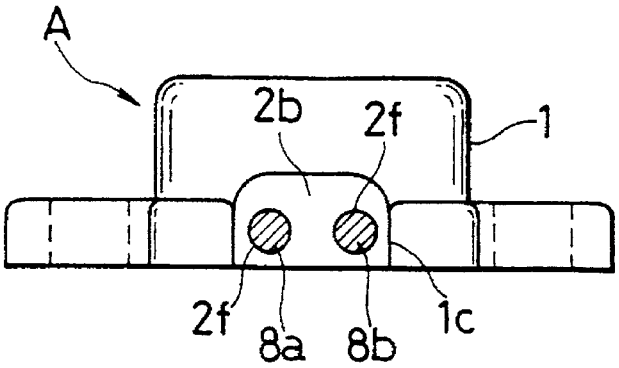
FIG. 4 is a left side view of FIG. 3.

The embodiments of this invention will be explained with reference to accompanying drawings.

FIGS. 1 to 5 show a first embodiment of a stop switch apparatus for an engine according to the present invention.

In FIGS. 1 to 5, character A indicates a stop switch apparatus for an engine, numeral 1 designates an outside case of the stop switch apparatus A, in which a bottom 1*a* of the outside case 1 is opened and a switch window 1*b* is formed at an upper surface, and a wiring window 1*c* is formed at one side.

An inside case 2 is mounted in the outside case 1. The inside case 2 is formed of rubber in a bag shape. A switch presser 2*a* to be exposed from the switch window 1*b* of the outside case 1 is formed at its upper surface, and a cable holder 2*b* to be mounted in the wiring window 1*c* is integrally formed with the one side.

A conductive rubber container 2*c* of a square shape is formed substantially at the center of the inner surface of the switch presser 2*a* of the inside case 2. Further, a reversal spring container 2*d* of a circular shape in contact with the conductive rubber container 2*c* is formed at the center of the conductive rubber container 2*c*. Positioning bosses 2*e* are projected at both sides of the conductive rubber container 2*c*. In addition, a guide hole 2*f* is opened at the cable holder 2*b*.

A reversal spring 3 as an example of a reversal member is contained in the reversal spring container 2*d* formed on the inner surface of the inside case 2. Further, a pressure sensitive conductive rubber 4 as an example of a pressure sensitive member is contained in the conductive rubber container 2*c*. The pressure sensitive conductive rubber 4 is in a so-called insulating state having a large resistance in a normal state in which a predetermined force is not applied and characteristics which become a conductive state when a predetermined force is applied at the center thereof.

The outer periphery of the reversal spring 3 is mounted on the pressure sensitive conductive rubber 4, and the center thereof is formed in a shape to be deformed in a convex state to the side of the reversal spring container 2*d*. When the reversal spring 4 is pushed at the center thereof by a force more than a set value, the reversal spring 4 is elastically deformed in a reversal state.

A substrate 6 is mounted on the inner surface of the inside case 2 through an insulating sheet 5. Positioning holes 5*a* and 6*a* are respectively opened at the insulating sheet 5 and the substrate 6. The positioning holes 5*a* and 6*a* are respectively mounted at the positioning bosses 2*e* to be positioned. The outer periphery of the substrate 6 is airtightly mounted on the inner periphery of the inside case 2.

A switch electrode 7*a* for constituting an engine stop switch unit 7 is printed in a pectinated state on the surface of the substrate 6 opposed to the pressure sensitive conductive rubber 4. Further, a conductive window 5*b* for forming an insulating space is opened between the switch electrode 7*a* and the pressure sensitive conductive rubber 4 on the insulating sheet 5. The conductive window 5*b* is formed in size smaller than the pressure sensitive conductive rubber 4, and hence a distance of the insulating space between the switch 7*a* and the pressure sensitive conductive rubber 4 is a thickness of the insulating sheet 5, i.e., 200 μm in the embodiment as shown in the drawings.

Electronic components such as capacitors and diodes for constituting an engine stop switch circuit 10 are mounted on the opposite surface of the substrate 6 to the switch electrode 7*a*, and base ends of two connecting cables 8*a* and 8*b* extended from the guide holes 2*f* opened at the cable holder 2*b* of the inside case 2 are connected thereto.

Further, a curable insulating base plate 9 made of epoxy resin or the like is filled between the substrate 6 and the bottom 1*a* of the outside case 1.

The substrate 6, the insulating sheet 5 and the inside case 2 are fixed in a close contact state in the outside case 1 by filling the curable insulating base plate 9 therein. The outer periphery of the inside case 2 is closely contacted with the inner surface of the outside case 1, and further the pressure sensitive conductive rubber 4 and the reversal spring 3 are interposed to be held between the switch presser 2*a* of the inside case and the insulating sheet 5.

Figure 5:
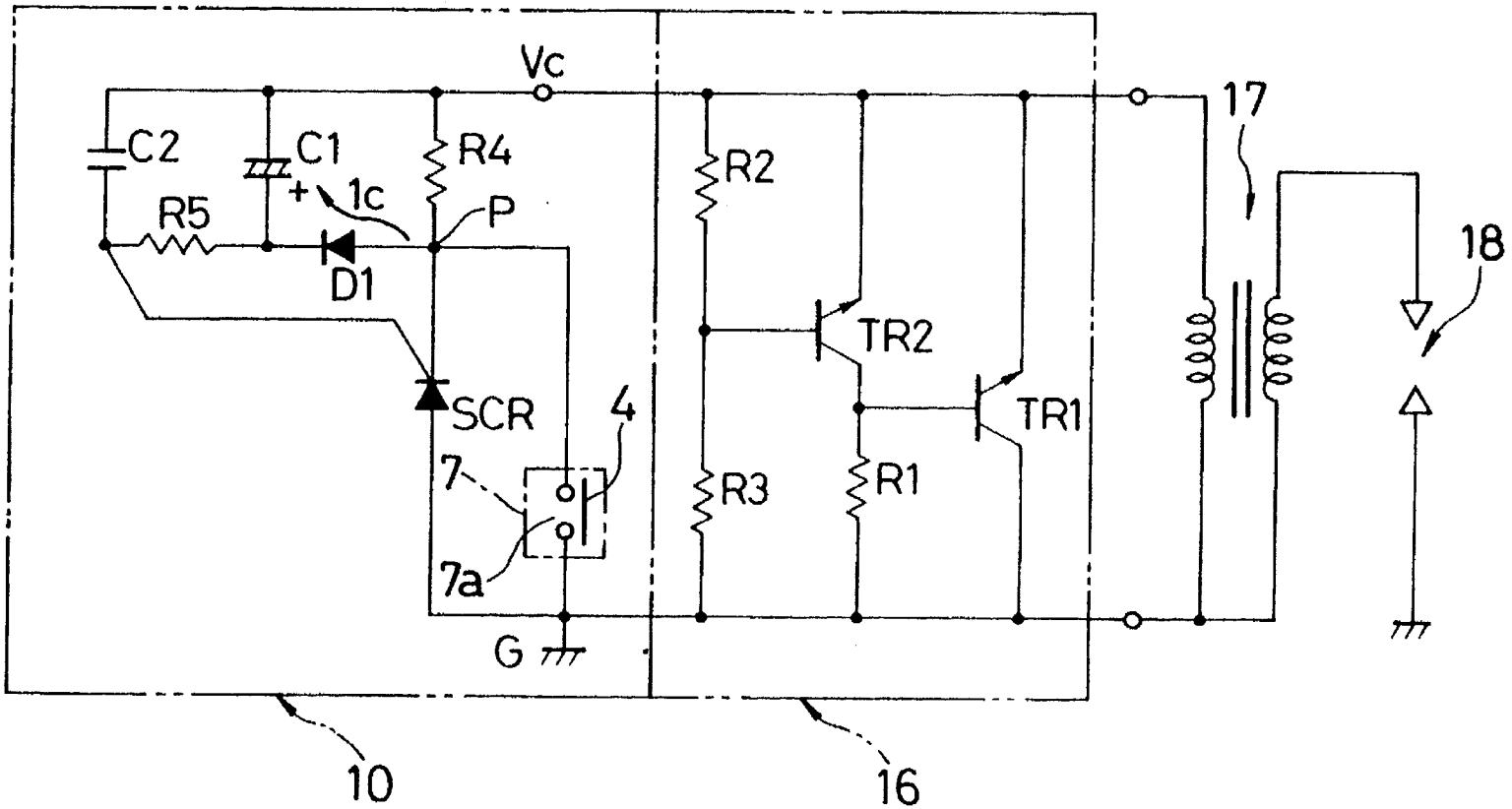
FIG. 5 is a circuit diagram of an engine stop switch circuit and an ignition circuit of the embodiment.

As shown in FIG. 5, a cathode side of a thyristor SCR for stopping the engine of the engine stop switch circuit 10 is connected to an anode side of a diode D1, connected to an ignition source circuit VC to be supplied from a magneto (not shown) through a resistor R4, and an anode side of the thyristor SCR for stopping the engine is further connected to an earth or ground G.

The other end of a holding capacitor C1 connected at its one end to the ignition source circuit VC is connected to the cathode side of the diode D1. Similarly, the other end of a capacitor C2 connected at its one end to the ignition source circuit VC is connected to the cathode side of the diode D1 through a resistor R5, and connected to the gate side of the thyristor SCR for stopping the engine.

The other end of the switch electrode 7*a* of the engine stop switch unit 7 connected at its one end to the ground G is connected to a connecting point P of the resistor R4, the anode side of the diode D1 and the cathode side of the thyristor SCR for stopping the engine.

On the other hand, an ignition circuit 16 is connected to the engine stop switch circuit 10. The emitter sides of transistors TR1 and TR2 of the ignition circuit 16 are connected to the ignition source circuit VC. The collector side of the power transistor TR1 is connected to the ground G, and further the collector side of the transistor TR2 is connected to the ground G through the resistor R1.

The base of the power transistor TR1 is connected to the collector side of the transistor TR2, and further the base of the transistor TR2 is connected to be branched between resistors R2 and R3 connected in series with the ignition source circuit VC and the ground G.

Numeral 17 illustrates an ignition coil. One end of a primary side of the ignition coil 17 is connected to the ignition source circuit VC, and the other end thereof is connected to the ground G. An ignition plug 18 is connected to a secondary side of the ignition coil 17.

Then, the operation of the embodiment of the arrangement as described above will be described.

While the engine is operating, an ac output synchronized with the revolution of the engine is normally applied as the ignition source circuit VC to the ignition circuit 16, the engine stop switch circuit 10 and the primary side of the ignition coil 17.

The thyristor SCR for stopping the engine is maintained in an off state in the engine stop switch circuit 10 as long as the engine stop switch unit 7 is not once turned on.

On the other hand, when the voltage of the source circuit VC of the ignition circuit 16 becomes negative, a bias voltage is applied to the base of the transistor TR2 via the resistors R1 and R2, the base voltage of the transistor TR2 is hence raised and the transistor TR2 is turned on. Then, the power transistor TR1 is turned on, the primary side of the ignition coil 17 is short-circuited, and hence a high voltage is generated at the primary side of the ignition coil 17.

As a result, a high voltage of an insulating breakdown voltage or higher between the electrodes of the ignition plug 18 is induced at the secondary side of the ignition coil 17 to be sparked, and further energy necessary for discharging is continued for a predetermined period of time by means of an attenuating vibration upon cutting-off of the primary side of the ignition coil 17.

When the engine is, on the other hand, stopped, the center of the switch presser 2*a* of the inside case 1 to be exposed from the switch window 1*b* of the outside case of the stop switch apparatus A for the engine is pressed. Then, the reversal spring 3 contained in the reversal spring container 2*c* formed on the inner surface of the switch presser 2*a* is reversed to press the pressure sensitive conductive rubber 4.

As a result, the pressure sensitive conductive rubber 4 is pressure-contacted with the switch electrode 7*a* formed on the substrate 6 to short-circuit the switch electrode 7*a*, thereby turning on the engine stop switch unit 7.

Since the stroke of the pressure sensitive conductive rubber 4 corresponds merely to a thickness of the insulating sheet 5, the fatigue of the pressure sensitive conductive rubber 4 is small even if the pressure sensitive conductive rubber 4 is turned on and off repeatedly. Further, even if the space sealed between the switch electrode 7*a* and the pressure sensitive conductive rubber 4 is expanded and contracted due to temperature change, its volumetric change is small and hence it does not affect adverse influence to the pressure sensitive conductive rubber 4 to obtain excellent durability.

Further, since the pressure sensitive conductive rubber 4 becomes conductive due to a reduction in its resistance value when a predetermined force is applied thereto, the engine stop switch circuit 10 is not, even if the pressure sensitive conductive rubber 4 is, for example, erroneously contacted with the switch electrode 7*a* due to aging change, erroneously operated in a normal state in which a predetermined force is not applied thereto. Further, a metal contact is eliminated by the use of the pressure sensitive conductive rubber 4, and hence a contact defect due to rust scarcely occurs, thereby further improving durability and reliability.

In addition, since the surface of the side to be pressed of the pressure sensitive conductive rubber 4 is protected by the reversal spring 3, the engine stop switch unit 7 is not, even if a slight external force is applied thereto, erroneously operated, thereby obtaining excellent durability and high reliability. Further, since the pressure sensitive conductive rubber 4 is merely interposed to be held between the reversal spring 3 and the insulating sheet 5, adherence of bond is eliminated to simplify assembling thereof.

Since the engine stop switch circuit 10 and the engine stop switch unit 7 are integrally assembled in the stop switch apparatus A for the engine, its assembling properties are improved, and handling thereof is facilitated. Further, since the switch electrode 7*a* is printed to be formed on the substrate 6, wirings are eliminated. Hence, the number of components can be not only deleted, but also the compact entire apparatus can be provided.

Further, since the outer surface of the inside case 2 is closely contacted with the inner surface of the outside case 1, water droplet is, for example, scarcely introduced from the switch window 1*b* of the outside case 1 into the stop switch apparatus, thereby obtaining excellent waterproofness and dustproofness. Since the outer periphery of the substrate 6 is mounted airtightly on the inside case 2 and yet the engine stop switch unit 7 is mounted at the center of the substrate 6, invasion of water droplet can be completely stopped on the way and hence the stop switch apparatus can be sufficiently used in the case out of a housing for a long period of time.

On the other hand, when the engine stop switch unit 7 is turned on at the time of stopping the engine, a charging current IC flows from the ground G side to the holding capacitor C1 through the diode D1 thereby to charge the holding capacitor C1.

When the ignition source circuit VC then becomes negative, a turn-on current is supplied to the gate of the thyristor SCR for stopping the engine at a time constant of the C1 and the R5. Then, a charging current flows from the thyristor SCR for stopping the engine to the holding capacitor C1.

Therefore, if the engine stop switch unit is once turned on, the thyristor SCR for stopping the engine is turned on and off repeatedly irrespective of the on/off of the engine stop switch unit 7.

When the thyristor SCR for stopping the engine is turned on, a current flows forwardly during a period in which the ignition source circuit voltage is negative to disable cut-off of the primary side of the ignition coil 17, thereby misfiring the engine to stop the engine.

As described above, according to this invention, the switch electrode of the engine stop switch unit and the engine stop switch circuit are integrally provided on the substrate. Therefore, wirings are eliminated, the engine apparatus can be decreased in size to realize a simplification, and hence the number of components and the number of assembling steps can be decreased.

Further, since the switch contact opposed to the switch electrode of the engine stop switch unit is formed of the pressure sensitive member, rust is not generated to avoid contact defect, and durability and reliability are improved.

Moreover, since the reversal member for setting a contact force to the switch electrode of the pressure sensitive member is interposed between the switch contact and the switch presser, an erroneous operation is eliminated, and reliability of the product can be further improved.

Figure 6:
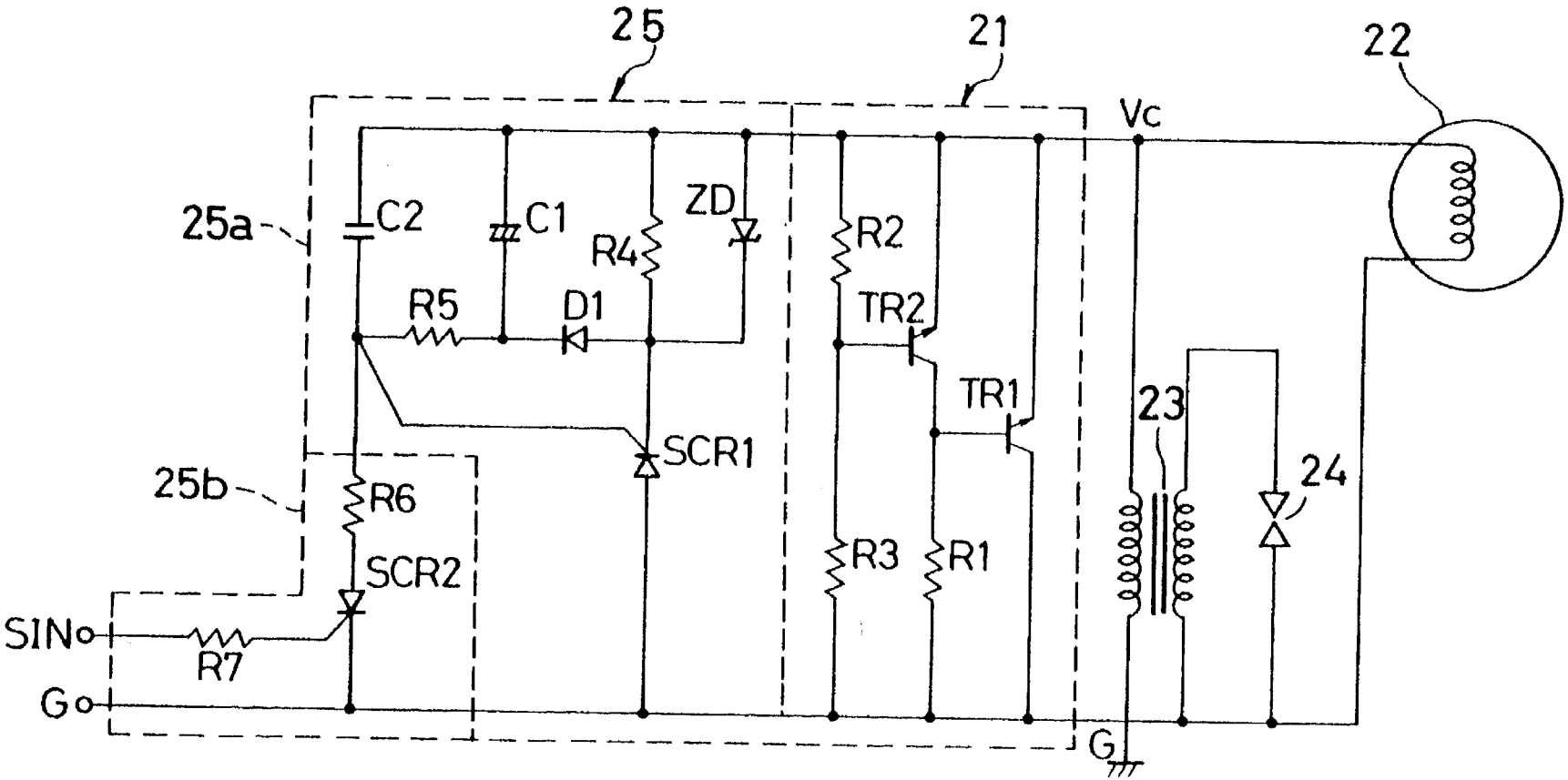
FIG. 6 is a circuit diagram of another example of FIG. 5.
Figure 7:
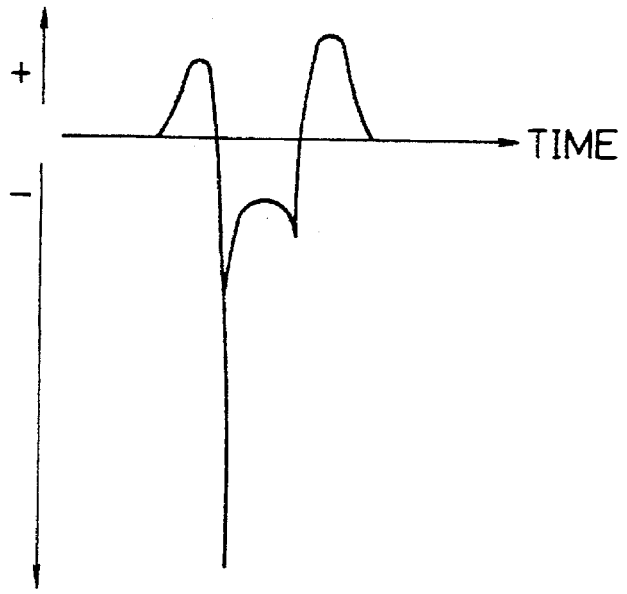
FIG. 7 is a waveform diagram illustrating a source circuit voltage when a thyristor for stopping the engine is turned off.
Figure 8:
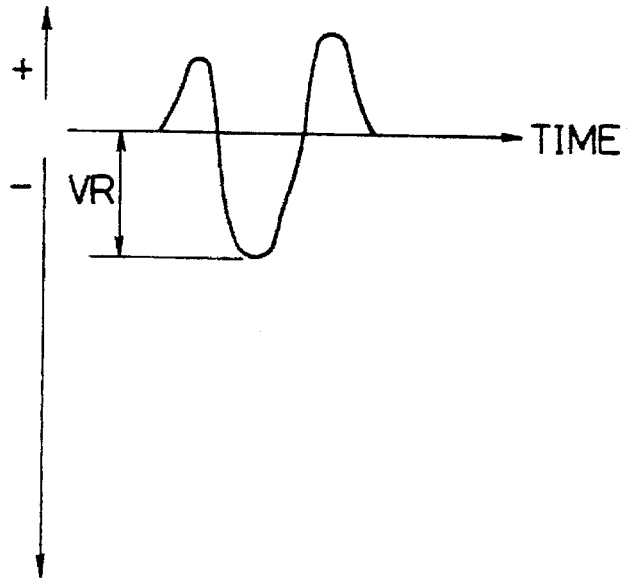

FIGS. 6 to 8 show another embodiment of this invention.

In FIG. 6, numeral 21 designates an ignition circuit of known transistor type. A source circuit voltage VC is supplied from a magneto 22 to the ignition circuit 21. The ignition circuit 21 and a primary side of an ignition coil 23 are connected to the ignition circuit 21 between an output end of the magneto 22 and a ground G, and an ignition plug 24 is connected to a secondary side of the ignition coil 23.

The ignition circuit 21 has a power transistor TR1 and a transistor TR2 of a front stage of the power transistor TR1 as main components. Emitters of the power transistor TR1 and the transistor TR2 are connected to the source circuit VC. A collector of the power transistor TR1 is connected to the ground G, and a collector of the transistor TR2 is connected to a base of the power transistor TR1, and further connected to the ground G through a resistor R1. A base of the transistor TR2 is connected to be branched between resistors R2 and R3 connected in series with the source circuit VC and the ground G.

An engine stop switch circuit 25 is connected to the ignition circuit 21. The engine stop switch circuit 25 has a source short circuit **25*a* and a trigger unit 25*b* for operating the source short circuit 25*a***.

The source short circuit **25*a* mainly has a thyristor SCR1 for stopping the engine to short-circuit the source circuit VC from the magneto 22, and a holding capacitor C1 for automatically retriggering the thyristor SCR1 for stopping the engine. The trigger unit 25*b*** is connected, for example, to a controller (not shown) for outputting an engine stop detection signal if an oil level of the engine becomes lower than a reference level, and mainly has a trigger thyristor SCR2 for firing the thyristor SCR1 for stopping the engine.

The thyristor SCR1 for stopping the engine is connected at an anode thereof to the ground G and at a cathode thereof to one end of a short-circuiting resistor R4 and a cathode of a zener diode ZD. The short-circuiting resistor R4 and the zener diode ZD are connected in parallel with each other, and the other end of the short-circuiting resistor R4 and an anode of the zener diode ZD are connected to the source circuit VC.

The gate of the thyristor SCR1 for stopping the engine is connected to the other end of a capacitor C2 connected at one end thereof to the source circuit VC, and further connected to the cathode of the diode D1 through a resistor R5. The other end of the holding capacitor C1 connected at one end thereof to the source circuit VC is connected to the cathode of the diode D1, and the anode of the diode D1 is connected to the anode of the thyristor SCR1 for stopping the engine.

Further, the gate of the thyristor SCR1 for stopping the engine is connected to the anode of the triggering thyristor SCR2 through a resistor R6, the gate of the thyristor SCR2 is connected to a signal input terminal SIN through a resistor R7, and the cathode of the thyristor SCR2 is connected to the ground G.

When an engine stop signal of a high level is input from a control circuit (not shown) to the signal input terminal SIN, the thyristor SCR2 is turned on to turn on the thyristor SCR1 for stopping the engine, the source circuit VC is short-circuited from the magneto 22, thereby forcibly stopping the engine.

Then, the operation of the another embodiment of the arrangement described above will be described.

An AC output synchronized with the revolution of the engine is normally supplied from the magneto 22 to the source circuit VC during the operation of the engine, and applied to the ignition circuit 21, the primary side of the ignition coil 23 and the engine stop switch circuit 25.

When the engine stop signal of a high level is not input from the signal input terminal SIN, the thyristor SCR1 for stopping the engine of the engine stop switch circuit 5 is hot fired by the thyristor SCR2 to be turned off. When the AC output from the magneto 22 becomes negative in this state, a bias voltage is applied to the base of the transistor TR2 by the resistors R1 and R2 of the ignition circuit 21.

Then, when the base voltage of the transistor TR2 reaches a level for turning on the transistor TR2, for example, at a predetermined timing such as BTDC 20°, the transistor TR2 is turned on. Thus, the power transistor TR1 is turned on to short-circuit a primary current of the ignition coil 23. As shown in FIG. 7, a voltage of about 400 V is, for example, generated at the negative side of the source circuit VC by a self-induction at the primary side of the ignition coil 23.

As a result, a high voltage of an insulating breakdown voltage or higher between electrodes of the ignition plug 24 is induced at the secondary side of the ignition coil 23 to spark the ignition plug 24. Further, an attenuating vibration to continue energy necessary for discharging for a predetermined period of time (e.g., about 2 msec.) is generated at the primary side of the ignition coil 23.

In this case, when the engine stop signal of a high level is input to the signal input terminal SIN of the engine stop switch circuit 25, the thyristor SCR2 is forwardly biased between the gate thereof and the cathode thereof, and the thyristor SCR2 is turned on.

If the polarity of the source circuit VC is positive, a forward current flows to the thyristor SCR2 through the short-circuiting resistor R4, the diode D1 and the resistors R5 and R6. Then, when the polarity of the source circuit VC is inverted to negative, the thyristor SCR2 is reversely biased between the anode thereof and the cathode thereof, and shifted to be turned off.

In this case, a recovery current flows to the thyristor SCR2 to charge the capacitor C2 and the holding capacitor C1, and to the thyristor SCR1 for stopping the engine. As a result, when the gate voltage of the thyristor SCR1 for stopping the engine is raised to reach the turn-on voltage, the thyristor SCR1 for stopping the engine is turned on. The recovery current is a current for recovering the thyristor SCR2 to a reverse blocking state. Thus, the thyristor SCR2 having a relatively long recovery time is employed so as to effectively utilize the recovery current.

When a short-circuiting current for short-circuiting the negative side of the source circuit VC through the short-circuiting resistor R4 flows by the turn-on of the thyristor SCR1 for stopping the engine, charge is stored in the holding capacitor C1 through the diode D1 by the voltage generated across the short-circuiting resistor R4. Then, the holding capacitor C1 is soon discharged to the gate of the thyristor SCR1 for stopping the engine at a time constant of the R5.C1.

The time constant R5.C1 is so set that the gate voltage of the thyristor SCR1 for stopping the engine rapidly reaches the turn-on voltage earlier than the turn-on of the transistor TR2 (power transistor TR1) of the ignition circuit 21. Thus, when the thyristor SCR1 is once turned on, charge stored in the holding capacitor C1 is circulated to the gate of the thyristor SCR1 for stopping the engine through the resistor R5, and the thyristor SCR1 for stopping the engine is turned on and off repeatedly irrespective of the on/off of the thyristor SCR2 (i.e., irrespective of the engine stop signal), thereby short-circuiting the source circuit VC.

In the case where the source circuit VC is short-circuited, when the voltage VR across the short-circuiting resistor R4 becomes a predetermined voltage or higher due to the irregularity in the output voltages of the magnetos 22 and the high frequency vibration when the source circuit VC is short-circuited, a portion of the short-circuiting current flows as a reversal current through the zener diode ZD connected in parallel with the short-circuiting resistor R4. As shown in FIG. 8, a voltage VR across the short-circuiting resistor R4, i.e., a voltage of the negative side of the source circuit VC is maintained substantially constant.

More specifically, the irregularity in the outputs of the magnetos 22 and the high frequency vibration are removed by the zener diode ZD connected in parallel with the short-circuiting resistor R4, a peak voltage to generate an inductive discharge at the ignition plug 24 through the ignition coil 3 is removed from the voltage VR at both ends of the short-circuiting resistor R4, thereby preventing malfunction of stopping the engine and generation of afterburn.

When ignition energy necessary to discharge the ignition plug 24 is removed from the primary side of the ignition coil 23 by the short-circuit of the source circuit VC, the ignition plug 24 is misfired, the rotation of the engine is gradually decelerated to stop the engine. The thyristor SCR1 for stopping the engine is completely turned off when the charge of the holding capacitor C1 is wasted and the final discharge is finished, and the engine becomes enable to start.

The gate voltage of the thyristor SCR1 for stopping the engine is, due to the presence of a delay time based on the time constant R5.C2 by the capacitor C2, suitably set at the resistor R5 and the capacitor C1 by considering the delay time of the turn-on. The resistor R6 is suitably set by considering the charging times of the holding capacitor C1 and the capacitor C2 by the recovery current of the thyristor SCR2.

In the another embodiment described above, the engine stop switch circuit 25 of the example which had the source short circuit **25*a* and the trigger unit 25*b* has been described. However, this invention is not limited to the particular embodiment. For example, the trigger unit 25*b*** is omitted, a normal open contact switch is connected between a cathode and a ground of the thyristor SCR1 for stopping the engine, and the switch may be closed only for a period of time in which the thyristor SCR1 for stopping the engine is automatically turned on by the holding capacitor C1, and the engine may be stopped.

According to the embodiment as described above, when the thyristor is turned on so as to stop the engine to short-circuit the source circuit to be supplied from the magneto to the ignition system and a short-circuiting current flows through the short-circuiting resistor. Then, since a portion of the short-circuiting current flows as a reversal current through the zener diode if the voltage at both ends of the short-circuiting resistor becomes a predetermined voltage or higher due to the irregularity in the output voltages of the magnetos and the high frequency vibration in the case of the short-circuiting, a peak voltage to generate discharge through the ignition system does not occur at both ends of the short-circuiting resistor. Therefore, malfunction of stopping the engine and generation of afterburn are prevented to obtain excellent engine stopping performance.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A stop switch apparatus for an engine, comprising:

an insulating base plate;

a substrate laid on said insulating base plate;

an electrode printed on said substrate;

an insulating sheet laid on said substrate for covering said electrode;

an inside case laid on said insulating sheet and having a pressure-movable portion movable toward said electrode;

an outside case fixed to said insulating base plate for covering said inside case and said substrate;

a pressure sensitive member laid on said insulating sheet for contacting said electrode when said pressure-movable portion of said inside case is pushed;

a reversal member interposed between said pressure sensitive member and said inside case, said reversal member deforming when a predetermined force is applied thereto to contact said pressure sensitive member and move said pressure sensitive member toward said electrode; and a stop switch circuit electrically connected to a source circuit including a switch, a thyristor and a resistor, said switch comprising said electrode and said pressure sensitive member, said thyristor being connected to said electrode and stopping said engine by grounding said source circuit when said thyristor receives a turn on signal, said resistor being directly connected to said source circuit and connected to said thyristor for providing a short circuit when said thyristor receives said turn on signal;

wherein said pressure sensitive member is an electrically conductive rubber and closes said stop switch circuit when moved into electrical contact with said electrode.

2. An engine stop switch circuit for an engine having a magneto for generating a high voltage current to an ignition plug via an ignition coil and an ignition circuit connected to said ignition coil and said magneto for inducing said high voltage current by a power transistor, comprising:

a thyristor responsive to a trigger signal for stopping said engine, said thyristor being connectable to said ignition circuit;

a resistor connected between said thyristor and said magneto for short-circuiting said ignition circuit when said thyristor is turned on by said trigger signal;

a capacitor connected to said magneto for setting a delay time to turn on said thyristor to stop said engine;

a holding capacitor connected to said magneto for holding a high voltage current for a predetermined time when a negative side of said magneto is short-circuited, said holding capacitor automatically retriggering said thyristor after a predetermined time delay;

and a zener diode connected in parallel with said resistor between said thyristor and said magneto, wherein when said ignition circuit is short-circuited by said thyristor being turned on in response to said trigger signal to turn said engine off, reverse current flows though said zener diode when voltage across said resistor reaches a predetermined value to reduce a peak voltage at both ends of said resistor when stopping said engine to avoid a malfunction in stopping said engine and generation of afterburn.

3. The engine stop switch circuit according to claim 2, further comprising:

a trigger circuit connected to said capacitor for generating said trigger signal to be inputted to said thyristor when said engine must be stopped.

4. The engine stop switch circuit according to claim 2, further comprising:

a normally open contact switch connected to said capacitor for generating said trigger signal to be inputted to said thyristor when said engine must be stopped.

* * * * *